US006833751B1

(12) United States Patent
Atrash

(10) Patent No.: US 6,833,751 B1
(45) Date of Patent: Dec. 21, 2004

(54) LEAKAGE COMPENSATION CIRCUIT

(75) Inventor: Amer Atrash, Atlanta, GA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/426,139

(22) Filed: Apr. 29, 2003

(51) Int. Cl.[7] ..... G05F 1/10
(52) U.S. Cl. ..... 327/534
(58) Field of Search ..... 327/415, 416, 327/530, 534, 535, 537, 538, 540, 541, 543

(56) References Cited

U.S. PATENT DOCUMENTS 5,633,611 A * 5/1997 Kohno et al. ..... 327/543
5,796,244 A 8/1998 Chen et al. ..... 323/313
5,900,773 A 5/1999 Susak ..... 327/539
6,072,306 A * 6/2000 Dondale ..... 323/312
6,075,407 A 6/2000 Doyle ..... 327/539
6,535,054 B1 3/2003 Ceekala et al. ..... 327/539

* cited by examiner

*Primary Examiner*—Jeffrey Zweizig
(74) *Attorney, Agent, or Firm*—Mark C. Pickering

(57) ABSTRACT

A leakage compensation circuit compensates for current changes that result from bulk leakage currents that occur when a current source transistor is connected to a number of switches. A leakage current flows out of a switch, while a compensation transistor connected to the switch sinks a current substantially equal to the leakage current.

20 Claims, 9 Drawing Sheets

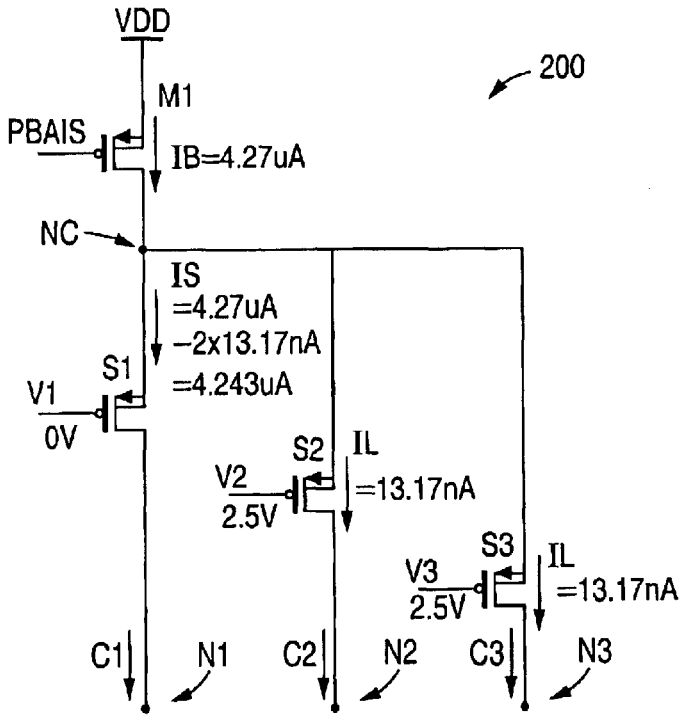
FIG. 2
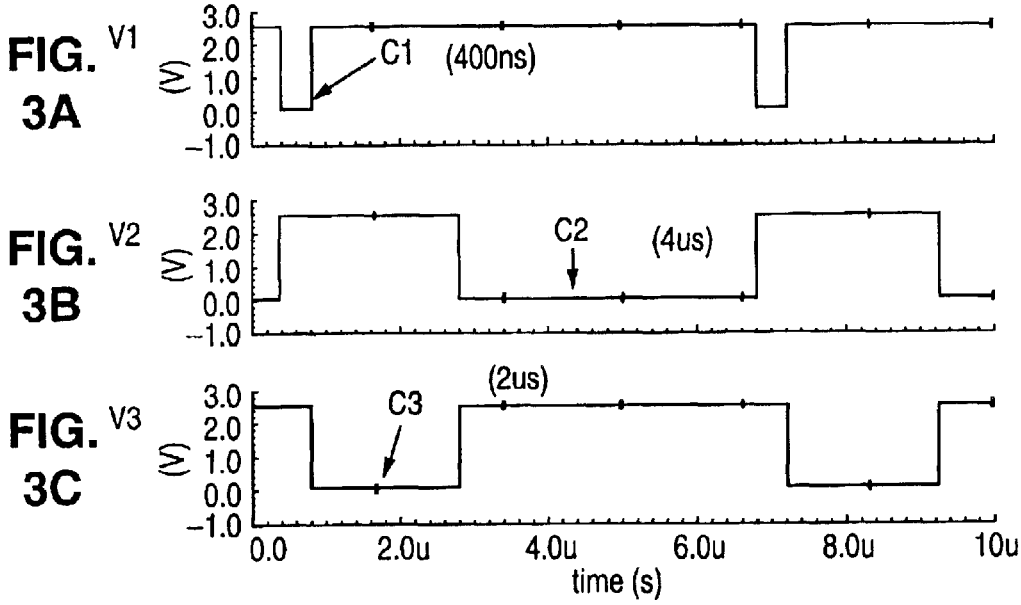

LEAKAGE COMPENSATION CIRCUIT

BRIEF DESCRIPTION OF THE DRAWINGS

FIG. 2 is a schematic diagram illustrating an example of an individual current source 200 in accordance with the present invention.

FIGS. 3A–3C are timing diagrams illustrating an example of the operation of current source 200 in accordance with the present invention.

DETAILED DESCRIPTION OF THE INVENTION

Figure 1:
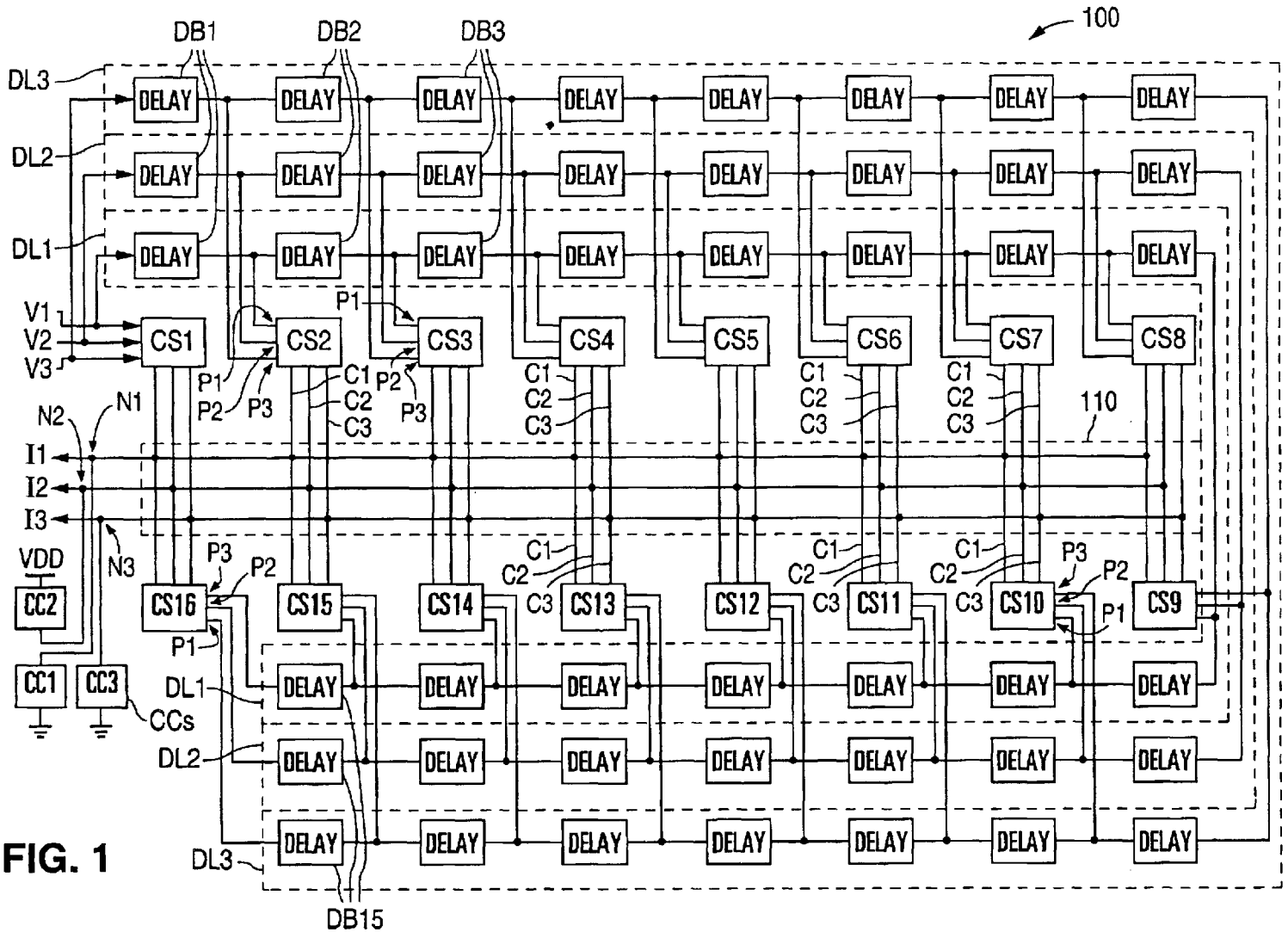
FIG. 1 is a schematic diagram illustrating an example of a witched current source 100 in accordance with the present invention.

The present invention compensates for changes in current that result from bulk leakage currents that occur when a transistor is connected to a number of switches. Bulk leakage current is significant predominantly for PMOS transistors at high temperatures, becoming the dominant source of error at temperatures above 150° C. FIG. 1 shows a schematic diagram that illustrates an example of a switched current source 100 in accordance with the present invention.

As shown in FIG. 1, switched current source 100 includes a number of substantially-equal, individual current sources CS. The number of individual current sources CS that are required for a particular application depends on the number of output currents I that are to be generated, and the relative magnitudes of the different output currents I.

The FIG. 1 example assumes that switched current source 100 generates first, second, and third output currents I1–I3, the second current I2 is 10× greater than the first current I1, and the third current I3 is 5× greater than the first current I1. In this case, 16 individual current sources CS1–CS16 that each generates the first output current I1 are required (one to generate the first current, ten to generate the second current, and five to generate the third current).

Each individual current source CS receives a number of phase voltages V at a corresponding number of phase inputs P, and outputs a corresponding number of currents C to a corresponding number of internal nodes in response to the phase voltages V. The number of phase voltages V corresponds with the number of output currents I. In the FIG. 1 example, since three output currents I1–I3 are generated, each current source CS1–CS16 receives three phase voltages V1–V3 at three phase inputs P1–P3, and outputs three currents C13 to three internal nodes N1–N3 in response to the phase voltages V1–V3.

FIG. 2 shows a schematic diagram that illustrates an example of an individual current source 200 in accordance with the present invention. As shown in FIG. 2, current source 200 includes a PMOS source transistor M1 that has a gate connected to a bias voltage PBIAS, and a source connected to the supply voltage VDD. In addition, transistor M1 has a body connected to the supply voltage VDD, and a drain connected to a circuit node NC. Transistor M1 can source, for example, 4.27 uA of current when formed as a high-voltage device in a 0.13-micron fabrication process (VDD=2.5V, T=200° C., and typical process). (A high-voltage device in a 0.13-micron fabrication process has a gate length greater than 0.13 microns.)

Individual current source 200 also includes a number of substantially-equal PMOS switch transistors S that correspond with the number of phase voltages V so that there is one switch transistor S for each phase voltage V. Following the FIG. 1 example, where three phase voltages V1–V3 are utilized, the FIG. 2 example shows individual current source 200 with three switch transistors S1–S3.

First switch transistor S1 has a gate connected to receive phase voltage V1, a source and body connected to circuit node NC, and a drain connected to a first internal node N1. Second switch transistor S2 has a gate connected to receive phase voltage V2, a source and body connected to circuit node NC, and a drain connected to a second internal node N2. Third switch transistor S3 has a gate connected to receive phase voltage V3, a source and body connected to circuit node NC, and a drain connected to a third internal node N3.

FIGS. 3A–3C show timing diagrams that illustrate an example of the operation of current source 200 in accordance with the present invention. As shown in FIG. 3, phase voltages V1–V3 have equal periods and are synchronized to each other such that voltage V1 falls when voltage V3 rises, voltage V2 falls when voltage V1 rises, and voltage V3 falls when voltage V2 rises.

Thus, only one PMOS switch transistor S1–S3 is turned on at a time in this example. In addition, voltage V1 has a duty cycle of (is low in this example for) 400 nS out of a 6.4 uS period, voltage V2 has a duty cycle of 4 uS out of the 6.4 uS period (ten times longer), while voltage V3 has a duty cycle of 2 uS out of the 6.4 uS period (five times longer).

In operation, a base current IB flows through source transistor M1 and into circuit node NC in response to the voltage PBIAS on the gate of transistor M1. When transistor S1 is turned on and transistors S2 and S3 are turned off, a switch current IS flows through transistor S1 to be output as current C1. Similarly, when transistor S2 is turned on and transistors S1 and S3 are turned off, the switch current IS flows through transistor 52 to be output as current C2, and when transistor 53 is turned on and transistors S1 and S2 are turned off, the switch current IS flows through transistor 53 to be output as current C3.

The switch current IS is less than the base current IB because the switches that are turned off at any given time output a bulk leakage current IL that reduces the base current IB that can flow through the switch that is turned on. For example, as shown in FIG. 2, when switch transistor S1 is turned on, if switch transistors S2 and S3 each have a leakage current IL of 13.17 nA, 2IL or 26.34 nA is drawn away from the base current IB. Thus, when the base current IB is equal to, for example, 4.27 uA, the switch current IS is equal to IB−2IL or 4.27 uA−26.34 nA=4.243 uA.

Returning again to FIG. 1, switched current source 100 further includes a number of delay lines DL that correspond with the number of phase voltages V. In addition, the delay lines DL are connected to the phase inputs P of the current sources CS such that each delay line DL is connected to the same phase input P of each current source CS.

In the FIG. 1 example, since three phase voltages V1–V3 are utilized, three delay lines DL1–DL3 are utilized. In addition, delay line DL1 is connected to phase input P1 of each current source CS1–CS16, while delay line DL2 is connected to phase input P2 of each current source CS1–CS16. Similarly, delay line DL3 is connected to phase input P3 of each current source CS1–S16.

Further, each delay line DL can be implemented with a number of delay blocks DB where the number of delay blocks DB is one less than the number of individual current sources CS. Thus, in the FIG. 1 example, 15 delay blocks DB1–DB15 are utilized. Each delay block DB, which sequentially delays the propagation of a phase voltage V, has a delay equal to the shortest duty cycle of the phase voltages V1–V3 which, in the FIG. 3 example, is phase voltage V1.

Each delay block DB also has an input connected to a phase input P of a corresponding current source CS, and an output connected to a corresponding phase input P of a next current source CS. For example, delay block DB2 of delay line DL2 has an input connected to phase input P2 of current source CS2, and an output connected to phase input P2 of next current source CS3. In addition, delay block DB15 has an input connected to phase input P2 of current source CS15, and an output connected to phase input P2 of next current source CS16.

Switching current source 100 also includes a number of compensation circuits CC that source current to or sink current from the internal nodes N1–N3 to compensate for current changes due to bulk leakage currents in the current sources CS. The number of compensation circuits CC corresponds with the number of output currents I. Thus, since three output currents I1–I3 are used in the FIG. 1 example, three compensation circuits CC1–CC3 are utilized.

Figure 4A:
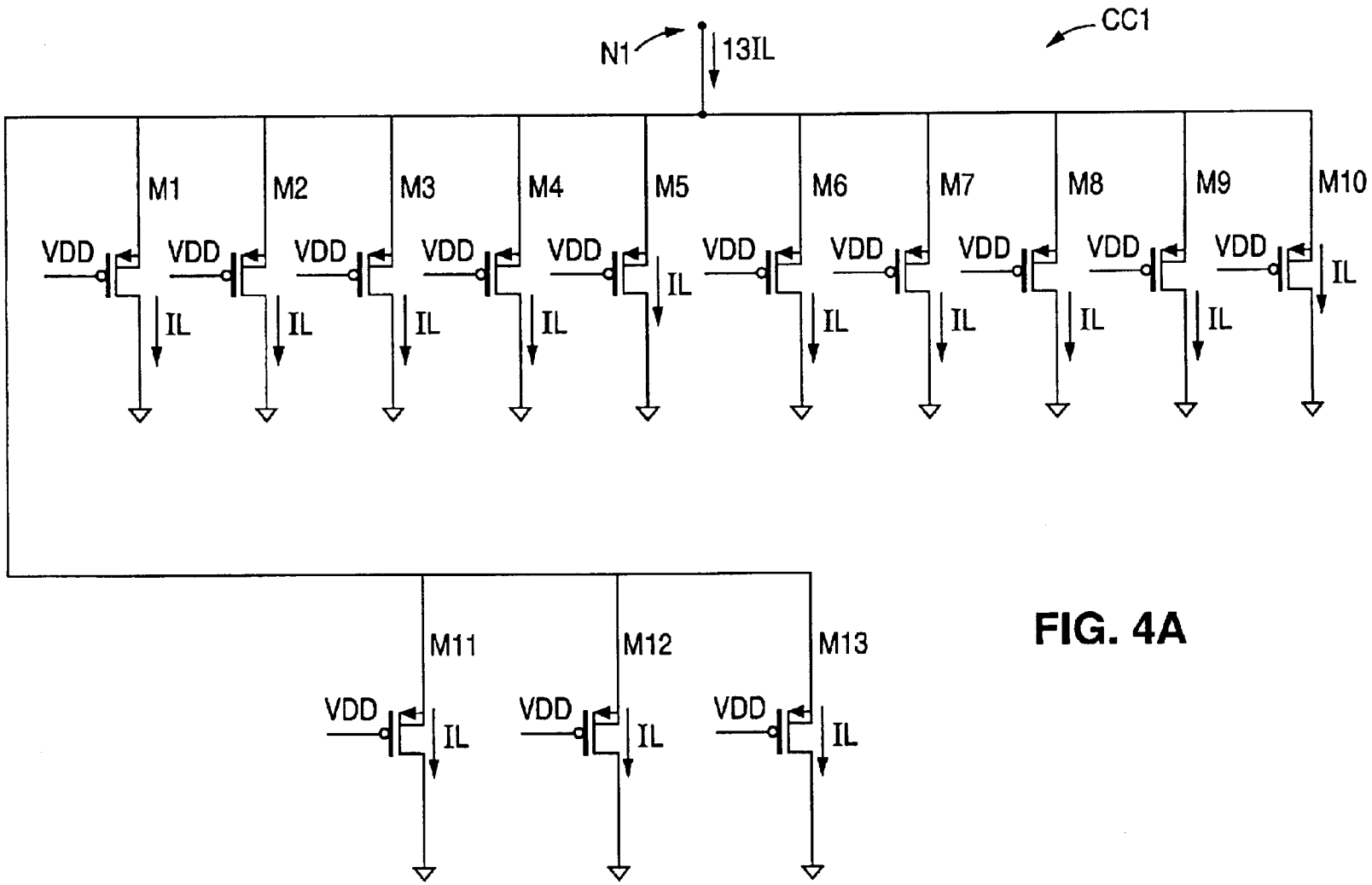
FIGS. 4A–4C are schematic diagrams illustrating an example of compensation circuits CC1–CC3, respectively, in accordance with the present invention.
Figure 4B:
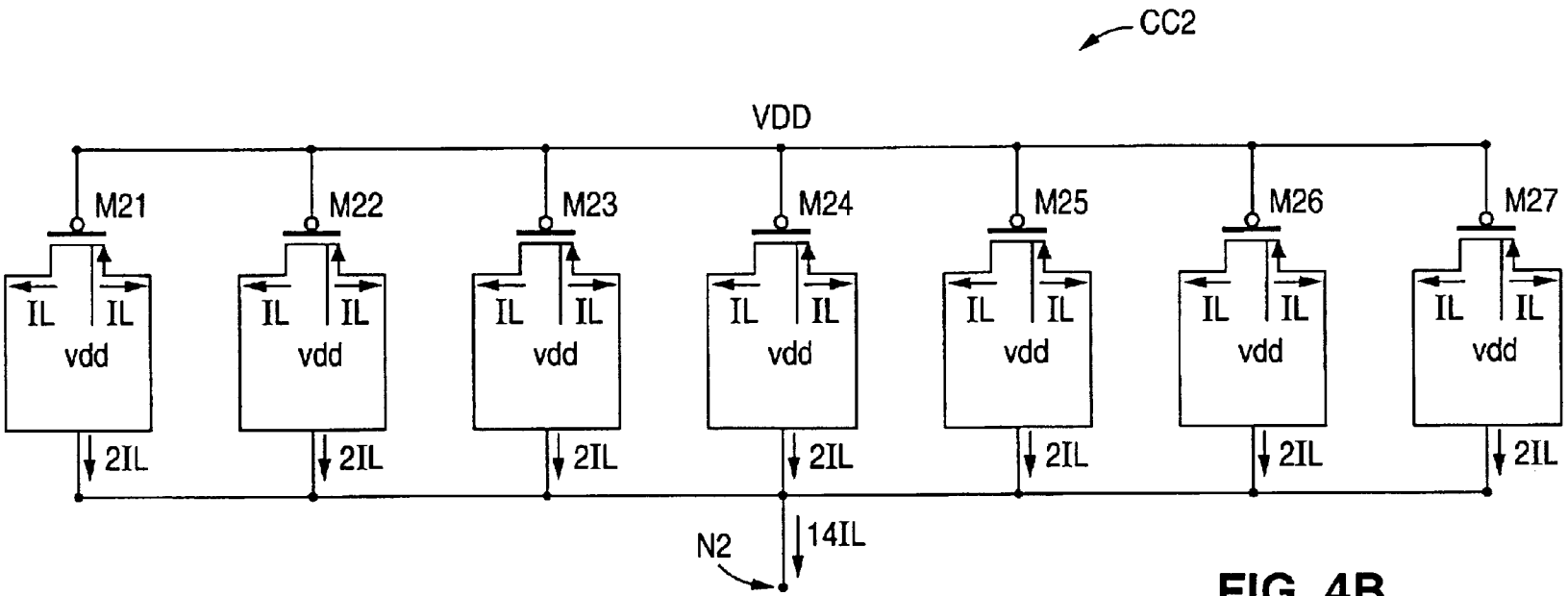
Figure 4C:
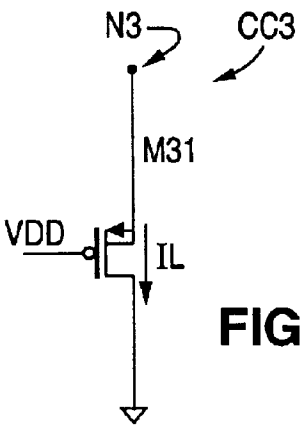

FIGS. 4A–4C show schematic diagrams that illustrate an example of compensation circuits CC1–CC3, respectively, in accordance with the present invention. Compensation circuit CC1 includes a number of substantially equivalent PMOS transistors that are connected together in parallel to each sink a leakage current from the first Internal node N1. The number of transistors used in compensation circuit CC1 depends on the number of leakage currents that need to be sunk.

Leakage currents flow out of the source and drain due to the reverse-biased source-to-bulk and drain-to-bulk junctions when a PMOS transistor has a gate and bulk connected to a power supply voltage VDD, and a source and drain connected to ground. Table 1 shows the total leakage current $I_{LEAK}$ for a PMOS transistor formed as a high voltage device in a 0.13-micron fabrication process with a supply voltage VDD of 2.5V for a number of transistor widths at 200° C.

The leakage current $I_{LEAK}$ is independent of the supply voltage VDD from 2.25V to 2.75V and is independent of device length. In addition, the leakage current $I_{LEAK}$ has been found to be independent of process variations in simulation, but is expected, along with the saturation current $I_{SAT}$, to vary with process variation. If the source and body are connected together, which eliminates the source-to-body leakage source, then the total leakage current $I_{LEAK}$ is half of that listed in Table 1.

TABLE 1

| Width | 500 nm | 1 um | 2 um | 4 um | 8 um |
|---|---|---|---|---|---|
| $I_{LEAK}$ | 26.33 nA | 37.12 nA | 58.71 nA | 101.9 nA | 188.2 nA |

The origin of bulk leakage current is a reverse-biased diode current from the well to the drain and source regions of a MOSFET. The current through a diode is given by:

$$I=I_{SAT}(e^{Vd/U_T}-1)$$

where Vd is the forward bias voltage across the diode, $I_{SAT}$ is the saturation current, and $U_T$ is q/kT. As a result, the current will saturate to a constant value of −IS for any reverse-biased voltage Vd larger than a few $U_T$.

In addition, the only way to bring the current to exactly zero is to make Vd exactly zero. Therefore, for a PMOS device, the bulk-source leakage current can be eliminated only if the bulk is tied back to the source. The bulk-drain voltage, however, is rarely zero, so some bulk-drain leakage is present in most devices. In the diode equation, the saturation current $I_{SAT}$ is known to be directly proportional to junction area. Therefore, the bulk leakage current can be expected to be proportional to the area of the source and drain regions that contact the bulk. Simulation results indicate a linear relationship between device periphery and leakage current.

In the FIG. 4A example, 13 PMOS transistors M1–M13 are utilized. Each transistor M1–M13 has a gate connected to a power supply voltage VDD, such as 2.5V, a source and a body connected to first internal node N1, and a drain connected to ground. In operation, transistors M1–M13 are turned off. Although turned off, a leakage current IL flows out of each transistor M1–M13 due to the reverse-biased drain-to-body junction. As a result, transistors M11–M13 sink a first compensation current from internal node N1 which, since 13 transistors are used, has a magnitude of 13IL.

Compensation circuit CC2 also includes a number of substantially equivalent PMOS transistors that are connected together in parallel to each source a leakage current into the second Internal node N2. The number of transistors used in compensation circuit CC2 depends on the amount of compensation that is required by the application, i.e., the number of leakage currents that need to be sourced.

In the FIG. 4B example, 7 PMOS transistors M21–M27 are utilized. Each transistor M21–M27 has a gate and a body connected to the power supply voltage VDD, and a source and a drain connected to internal node N2. In operation, transistors M21–M27 are turned off. Although turned off, two leakage currents IL flow out of each transistor M21–M27 due to the reverse-biased source-to-body and drain-to-body junctions. As a result, transistors M21–M27 source a second compensation current into internal node N2 which, since 7 transistors are utilized, has a magnitude of 14IL.

Compensation circuit CC3 further includes a number substantially equivalent PMOS transistors that are connected in parallel to each sink a leakage current from the third internal node N3. The number of transistors used in compensation circuit CC3 depends on the amount of compensation that is required by the application, i.e., the number of leakage currents that need to be sunk.

In the FIG. 4C example, 1 PMOS transistor M31 is utilized.

Transistor M31 has a gate connected to the power supply voltage VDD, a source and a body connected to internal node N3, and a drain connected to ground. In operation, transistor M31 is turned off. Although turned off, a leakage current IL flows out of transistor M31 due to the reverse-biased drain-to-body junction. As a result, transistor M31 inks a third compensation current from internal node N3 which has a magnitude of IL.

In operation, with reference to FIG. 1, the phase voltages V1–V3 are input to the first current source CS1 and the first delay block DB1 of the delay lines DL1–DL3. The phase voltages V1–V3 sequentially turn on the switch transistors S1–S3 (FIG. 2) of the current sources CS, and at the same time propagate through the delay blocks DB of delay lines DL1–DL3.

In the FIG. 3 example, phase voltage V1 is low for 400 nS, which turns on switch transistor S1 of current source CS1 for 400 nS. In addition, as noted above, the delay of each delay block DB is equal to the shortest duty cycle of the phase voltages V1–V3 which, in the FIG. 3 example, is phase voltage V1.

As a result, the leading (falling) edge of phase voltage V1 is output from delay block DB1 of delay line DL1 and input to current source CS2, thereby turning on switch transistor S1 of current source CS2, at the same time that the trailing (rising) edge of phase voltage V1 is input to current source CS1, thereby turning off switch transistor S1 of current source CS1.

Phase voltage V1 continues to propagate through delay line DL1 sequentially turning on one current source CS at a time. Thus, when one current source CS is turned on, the remaining current sources CS are turned off. In other words, when switch transistor S1 of one current source CS is turned on, the switch transistors S1 of the remaining 15 current sources are turned off.

As further noted above, when a switch transistor S of a current source is turned on, the switch transistor S outputs a current C=IS=IB−2IL (where the base current IB in this example is reduced by the leakage current IL of the two switch transistors S that are turned off). In addition, when a switch transistor S in a current source CS is turned off, the switch transistor S also outputs a leakage current IL. Thus, when 16 current sources CS1–CS16 are used and only one current source CS is on at a time, 15 current sources CS are off and contributing a total leakage current of 15IL.

Thus, as phase voltage V1 propagates through delay line DL1, one switch transistor S is always on providing a current C=IB−2IL, while 15 switch transistors S are off providing a leakage current of 15IL. As a result, the total current input to internal node N1 is equal to IB−2IL+15IL=IB+13IL.

As additionally noted above, compensation circuit CC1 sinks a first compensation current equal to 13IL from internal node N1. As a result, internal node N1 outputs current I1 as IB+13IL−13IL=IB. Thus, by using compensation circuit CC1 to sink a leakage current that is equal to the net current difference resulting from the switches that are turned on and off, the present invention compensates for losses that result from bulk leakage currents.

In the FIG. 3 example, phase voltage V2 has a duty cycle of (is low for) 4 uS, which turns on switch transistor S2 of current source CS1 for 4 uS. Since the delay of each delay block DB is equal to the duty cycle of the shortest duty cycle, which is 400 nS, phase voltage V2 is low for 10 delay periods.

As a result, the leading (falling) edge of phase voltage V2 passes through 9 delay blocks DB and turns on the switch transistor S2 in current sources CS1–CS10 before the leading edge is output from delay block DB10. When the leading edge is output from delay block DB10 of delay line DL2 and input to current source Cs11, thereby turning on switch transistor S2 of current source CS11, the trailing (rising) edge of phase voltage V2 is at the same time input to current source CS1, thereby turning off switch transistor S2 of current source CS1.

Phase voltage V2 continues to propagate through delay line DL2 sequentially turning on ten current source CS at a time. Thus, when 10 current sources CS are turned on, the remaining 6 current sources CS are turned off. In other words, when the switch transistors S2 of 10 current sources CS are turned on, the switch transistors S2 of the remaining 6 current sources CS are turned off.

As noted above, when a switch transistor S of a current source is turned on, the switch transistor S outputs a current C=IS=IB−2IL (where the base current IB in this example is reduced by the leakage current IL of the two switch transistors S that are turned off). In addition, when a switch transistor S in a current source CS is turned off, the switch transistor S also outputs a leakage current IL. Thus, when 16 current sources CS1–CS16 are used and 10 current sources CS are on at a time, 6 current sources CS are off and contributing a total leakage current of 6IL.

Thus, as phase voltage V2 propagates through delay line DL2, 10 switch transistors S are always on providing a current C=10(IB−2IL), while 6 switch transistors S are off providing a leakage current of 6IL. As a result, the total current input to internal node N2 from the current sources is equal to 10IB−20IL+6IL=10IB−14IL.

As additionally noted above, compensation circuit CC2 sources a second compensation current equal to 14IL into internal node N2. As a result, internal node N2 outputs current I2 as 10IB−14IL+14IL=10IB. Thus, by using compensation circuit CC2 to source a leakage current that is equal to the net current difference resulting from the switches that are turned on and off, the present invention compensates for losses that result from bulk leakage currents.

In the FIG. 3 example, phase voltage V3 has a duty cycle of (is low for) 2 uS, which turns on switch transistor S3 of current source CS1 for 2 uS. Since the delay of each delay block DB is equal to the duty cycle of the shortest duty cycle, which is 400 nS, phase voltage V3 is low for 5 delay periods.

As a result, the leading (falling) edge of phase voltage V3 passes through 4 delay blocks DB and turns on the switch transistor S3 in current sources CS1–CS5 before the leading edge is output from delay block DB5. When the leading edge is output from delay block DB5 of delay line DL3 and input to current source CS6, thereby turning on switch transistor S3 of current source CS6, the trailing (rising) edge of phase voltage V3 is at the same time input to current source CS1, thereby turning off switch transistor S3 of current source CS1.

Phase voltage V3 continues to propagate through delay line DL3 sequentially turning on five current source CS at a time. Thus, when 5 current sources CS are turned on, the remaining 11 current sources CS are turned off. In other words, when the switch transistors S3 of 5 current sources CS are turned on, the switch transistors S3 of the remaining 11 current sources CS are turned off.

As noted above, when a switch transistor S of a current source is turned on, the switch transistor S outputs a current C=IS=IB−2IL (where the base current IB in this example is reduced by the leakage current IL of the two switch transistors S that are turned off). In addition, when a switch transistor S in a current source CS is turned off, the switch transistor S also outputs a leakage current IL. Thus, when 16 current sources CS1–CS16 are used and 5 current sources CS are on at a time, 11 current sources CS are off and contributing a total leakage current of 11IL.

Thus, as phase voltage V3 propagates through delay line DL3, 5 switch transistors S are always on providing a current C=5(IB−2IL), while 11 switch transistors S are off providing a leakage current of 11IL. As a result, the total current input to internal node N3 is equal to 5IB−10IL+11IL=5IB+IL.

As additionally noted above, compensation circuit CC3 sinks a third compensation current equal to IL from internal node N3. As a result, internal node N3 outputs current I3 as 5IB+IL−IL=5IB. Thus, by using compensation circuit CC3 to sink a leakage current that is equal to the net current difference resulting from the switches that are turned on and off, the present invention compensates for losses that result from bulk leakage currents.

Table 2 shows the magnitude of the currents I1–I3 at 200° C. with and without compensation circuits CC1–CC3 for a supply voltage VDD of 2.5V and typical process. Simulation results indicate that the leakage currents can be corrected for almost exactly.

TABLE 2

| | Ideal | Uncorrected | Corrected |
|---|---|---|---|
| IB | 4.27 uA | 4.01 uA | 4.27 uA |
| I1 | 4.27 uA | 4.18 uA | 4.27 uA |
| I2 | 42.7 uA | 39.93 uA | 42.7 uA |
| I3 | 21.35 uA | 20.07 uA | 21.35 uA |
| I2/I1 | 10 | 9.54 | 10 |

(The base current IB changes when the compensation circuits CC1–CC3 are utilized in this example because the voltage PBIAS connected to the gate of transistor M1 of FIG. 2 is the output of an operational amplifier (op amp). In this case, the op amp finds a different stable point due to the slightly different ratio between current I2 and current I1 (9.54:1 instead of the ideal 10:1).)

Thus, the composition of compensation circuits CC1–CC3 are calculated by first determining the number of individual PMOS transistors that output the source current IS at the same time to a common node. For example, with current I1 only one current source, and therefore only one transistor, outputs the source current IS to the common node.

Next, the difference between the magnitude of the source current IS and the magnitude of the base current IB is determined. In the above example, three switches are connected in parallel and, as a result, the difference between the magnitudes of the source and base currents is two leakage currents 2IL.

After this, the total current lost due to leakage is calculated by multiplying the difference times the number of individual PMOS transistors that output the source current IS to the common node at the same time. Since only one current source is on at the same time with current I1, the total current lost to leakage is equal to 2IL.

After the total current lost to leakage has been determined, the total current added to the common node due to leakage is calculated by determining the number of individual PMOS transistors that are turned off, and thereby output a leakage current to the common node, at the same time.

Following this, the number of individual PMOS transistors that output the leakage current to the common node at one time is multiplied times the leakage current to obtain a total added leakage current that is output to the common node. In the current I1 example, 15 current sources are turned off at the same time and therefore output a total current added due to leakage of 15IL to the common node.

Next, the total current lost and the total added due to leakage is combined to determine a combined result. For example, 15IL of leakage current is added to the common node, while the switch current IS is two leakage currents 2IL less due to leakage. Thus, the total current output to the common node is the switch current IS plus 13IL of leakage.

Once the combined result has been determined, the magnitude of a compensation leakage current provided by a compensation PMOS transistor is determined. In this example, 13IL of current needs to be removed from the common node to result in the common node outputting only the switch current IS.

Following this, a number of compensation PMOS transistors are connected to the common node so that the total compensation leakage current is equal to an opposite magnitude of the combined result. For example, 13 PMOS transistors can be connected in parallel, with sources and bodies tied together, to sink a current equal to 13IL from the common node.

Figure 5:
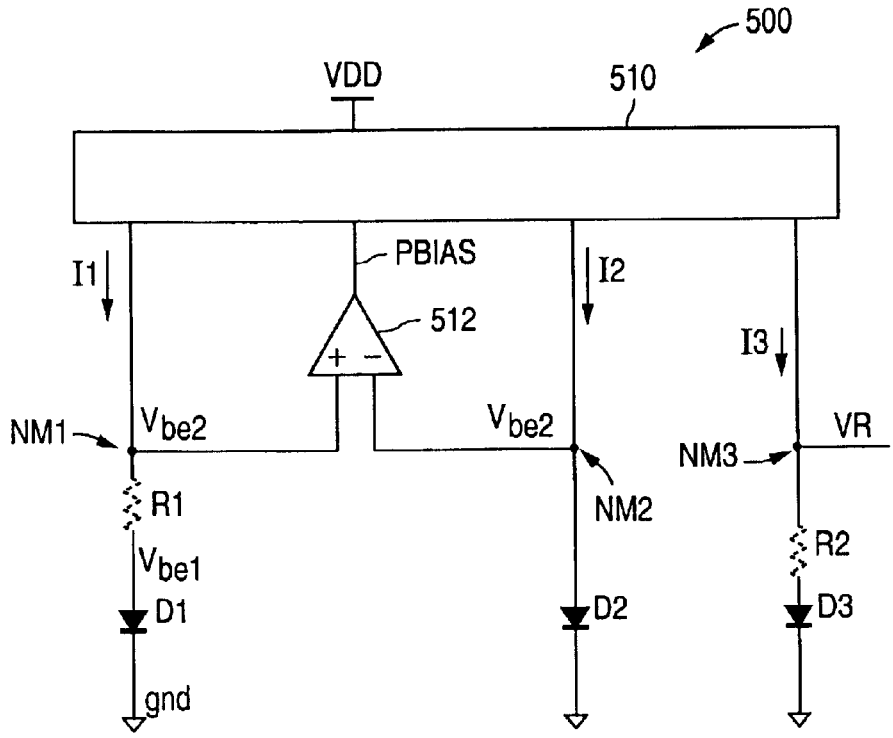
FIG. 5 is a schematic diagram illustrating an example of a bandgap reference circuit 500 in accordance with the present invention.

One application of current source 100 is in a bandgap reference circuit. FIG. 5 shows a schematic diagram that illustrates an example of a bandgap reference circuit 500 in accordance with the present invention. As shown in FIG. 5, circuit 500 includes a current source 510, such as current source 100, that outputs first, second, and third output currents I1, I2, and I3 to intermediate nodes NM1, NM2, and NM3 in response to a bias signal PBIAS.

As further shown in FIG. 5, bandgap reference circuit 500 also includes an operational amplifier (op amp) 512 that has a positive input connected to intermediate node NM1, a negative input connected to intermediate node NM2, and an output that generates the bias signal PBIAS.

Circuit 500 further includes a resistor R1 and a diode D1 that are connected in series between the positive input of op amp 512 and ground, and a diode D2 that is connected between the negative input of op amp 512 and ground. Circuit 500 additionally includes a resistor R2 and a diode D3 that are connected in series between intermediate node NM3 and ground.

In operation, the negative feedback forces the voltage on the negative input of op amp 512, which is equal to a junction voltage drop, such as a base-emitter voltage Vbe2 of diode D2, to be present on the positive input of op amp 512. If a junction voltage, such as a base-emitter voltage Vbe1, is dropped across diode D1, then the output current I1 through resistor R1 is defined by Vbe2−Vbe1/R1.

If the output current I1 is Vbe2−Vbe1/R1, then the third current I3 must be five times larger 5(Vbe2−Vbe1)/R1. As a result, a reference voltage VR at the intermediate node NM3 is equal to 5(Vbe2−Vbe1)R2/R1 plus a junction voltage drop such as a base-emitter voltage Vbe3 across diode D3 (5(Vbe2−Vbe1)(R2/R1)+Vbe3).

Temperature independence is achieved when the term 5(Vbe2−Vbe1)R2/R1 and the term Vbe3 cancel each other out. At room temperature, the term Vbe2−Vbe1 has a temperature coefficient of k/q ln(10)=0.198 mW/° C., while the term Vbe has a temperature coefficient of −1.7 mV/° C.

Figure 6A:
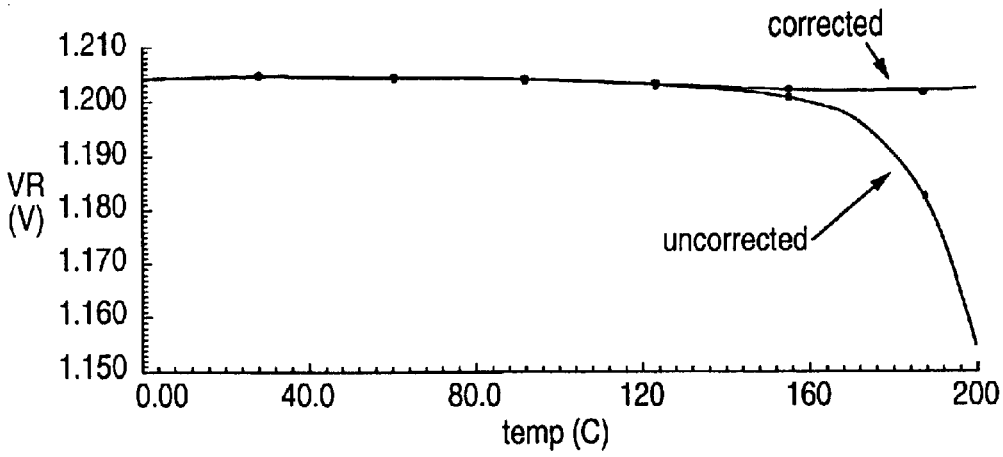
FIGS. 6A–6B are graphs illustrating an example of the reference voltage VR output from bandgap circuit 500 over temperature when current source 510 includes and excludes compensation circuits CC1–CC3 in accordance with the present invention.
Figure 6B:
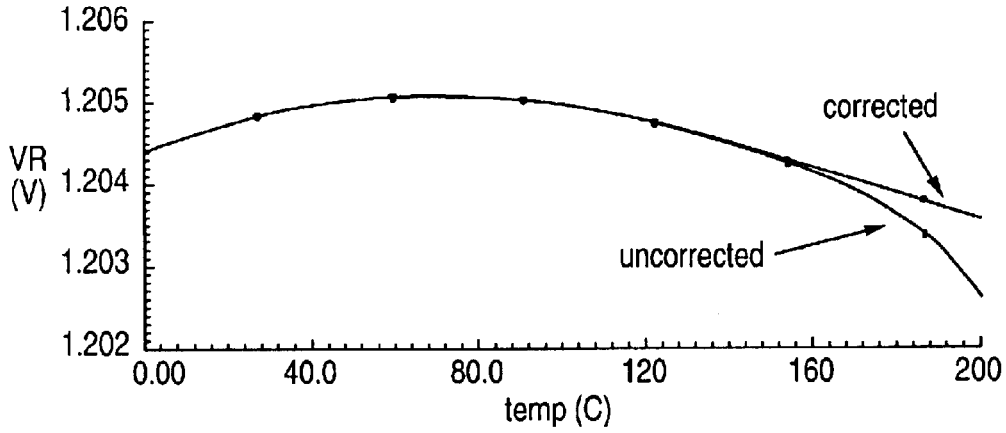

FIGS. 6A–6B show graphs that illustrate an example of the reference voltage VR output from bandgap circuit 500 over temperature when current source 510 includes (corrected) and excludes (uncorrected) compensation circuits CC1–CC3 in accordance with the present invention. As shown in FIGS. 6A and 6B, there is significant improvement at higher temperatures when current source 510 is utilized.

Figure 7:
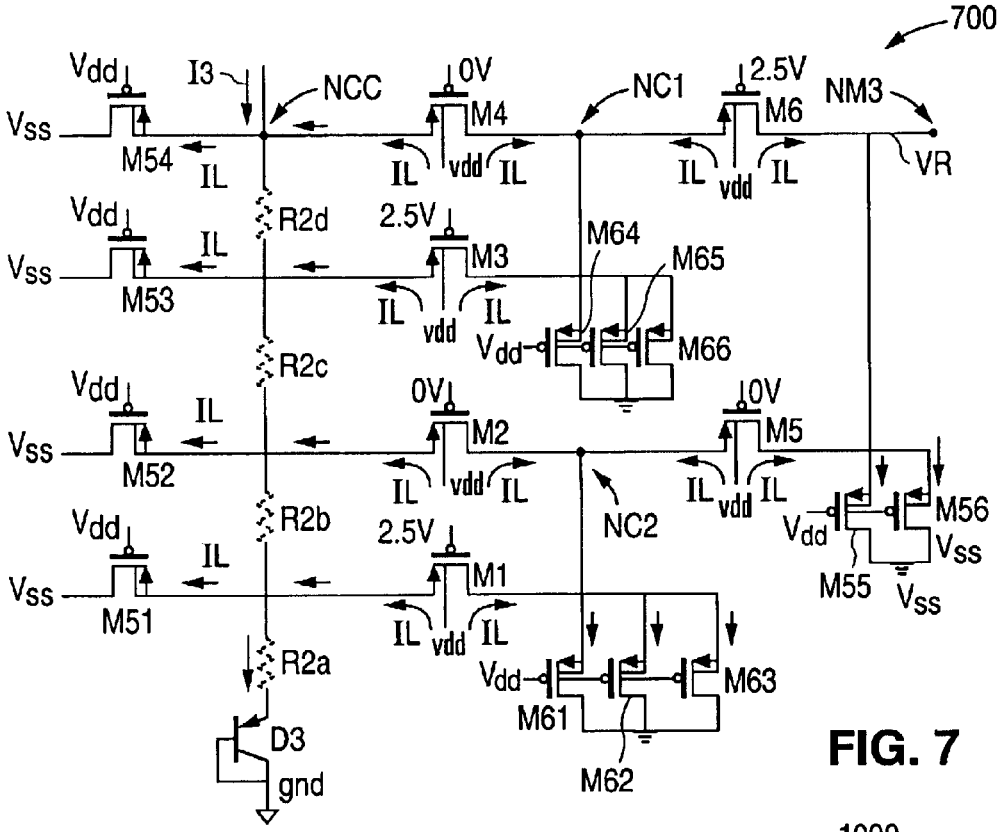
FIG. 7 is a schematic diagram illustrating an example of a two-bit trim circuit 700 in accordance with the present invention.

FIG. 7 shows a schematic diagram that illustrates an example of a two-bit trim circuit 700 in accordance with the present invention. Circuit 700 includes a number of serially-connected resistors R and a diode D that are connected between a circuit node NCC and ground. In the FIG. 7 example, four serially-connected resistors R2*a*, R2*b*, R2*c*, and R2*d* and a diode D3, which has an emitter connected to resistor R2*a*, and a base and collector connected to ground, are utilized.

Circuit 700 also includes a number of PMOS switch transistors that are connected to resistors R2*a*–R4*a* to define a reference voltage VR at an intermediate node NM3 based on which switches are open and closed. The switch transistors include a number of PMOS first switch transistors that each has a source connected to a resistor.

In the FIG. 7 example, four first PMOS select transistors M1–M4 are utilized. Transistor M1 has a source connected to resistors R2*a* and R2*b*, a gate, a drain connected to a circuit node NC1, and a body connected to a power supply voltage VDD. Transistor M2 has a source connected to resistors R2*b* and R2*c*, a gate, a drain connected to circuit node NC1, and a body connected to the power supply voltage VDD.

Transistor M3 has a source connected to resistors R2*c* and R2*d*, a gate, a drain connected to a circuit node NC2, and a body connected to the power supply voltage VDD. Transistor M4 has a source connected to resistor R2*d*, a gate, a drain connected to circuit node NC2, and a body connected to the power supply voltage VDD.

The switch transistors also include a number of second PMOS switch transistors that connect the first switch transistors to the intermediate node NM3. In the FIG. 7 example, two PMOS second switch transistors M5–M6 are utilized to limit the number of drains of first switch transistors that can be connected to a common circuit node to two.

Transistor M5 has a source connected to circuit node NC2 (the drains of transistors M1 and M2), a gate, a drain connected to the intermediate node NM3, and a body connected to a power supply voltage VDD. Transistor M6 has a source connected to circuit node NC1 (the drains of transistors M3 and M4), a gate, a drain connected to the intermediate node NM3, and a body connected to the power supply voltage VDD.

In operation, a current I3 flows into circuit node NCC, and from circuit node NCC through resistors R2*a*–R4*a* and diode D3 to ground. The reference voltage VR, in turn, Is defined by which of the first and second switch transistors are turned on and off. In the FIG. 7 example, transistor M5 is turned on and transistor M6 is turned off. In addition, transistor M1 is turned off and transistor M2 is turned on. As a result, the voltage at the node between resistors R2*b* and R2*c* sets the value of the reference voltage VR at the intermediate node N3.

In accordance with the present invention, circuit 700 further includes a number of PMOS first correction transistors that correspond with the number of first switch transistors, and a number of PMOS second correction transistors that correspond with the number of second switch transistors.

In addition, circuit 700 also includes a number of PMOS third correction transistors that are connected to the first and second switch transistors such that, for each circuit node that is connected to a first and a second switch transistor, a third correction transistor is connected to a node for each first and second switch transistor that is connected to the node.

In the FIG. 7 example, since four first switch transistors M1–M4 are utilized, four PMOS first correction transistors M51–M54 are utilized.

Transistor M51 has a source and body connected to resistors R2*a* and R2*b*, a gate connected to the supply voltage VDD, and a drain connected to ground. Transistor M52 has a source and body connected to resistors R2*b* and R2*c*, a gate connected to the supply voltage VDD, and a drain connected to ground.

Transistor M53 has a source and body connected to resistors R2*c* and R2*d*, a gate connected to the power supply VDD, and a drain connected to ground. Transistor M54 has a source and body connected to resistor R2*d*, a gate connected to the power supply VDD, and a drain connected to ground.

In addition, in the FIG. 7 example, since two second switch transistors M5–M6 are utilized, two PMOS second correction transistors M55 and M56 are utilized. Transistors M55 and M56 both have a source and body connected to intermediate node NM3, a gate connected to the power supply voltage VDD, and a drain connected to ground.

Further, since nodes NC1 and NC2 in the FIG. 7 example are connected to first and second switch transistors M1–M6, and three first and second switch transistors are each connected to nodes NC1 and NC2, six PMOS third compensation transistors M61–M66 are utilized in the FIG. 7 example.

Each transistor M61–63 has a source and body connected to the drains of first switch transistors M1–M2 and one second switch transistor M5, a gate connected to the power supply voltage VDD, and a drain connected to ground. Each transistor M64–M66 has a source and body connected to the drains of first switch transistors M3–M4 and one second switch transistor M6, a gate connected to the power supply voltage VDD, and a drain connected to ground.

In operation, transistors M51–M54 are turned off. Although turned off, a leakage current IL flows out of each transistor M51–M54 due to the reverse-biased drain-to-body junction. As a result, transistors M51–M54 each sink a first compensation current equal to IL. The first compensation currents sunk by transistors M51–M54 sink the leakage current IL output by each first switch transistor M1–M4 due to the reverse-biased source-to-body junction.

In addition, transistors M55–M56 are turned off. Although turned off, a leakage current IL flows out of each transistor M55–M56 due to the reverse-biased drain-to-body junction. As a result, transistors M55–M56 each sink a second compensation current equal to IL, for a total of 2IL. The second compensation currents sunk by transistors M55–M56 sink the leakage current IL output by each second switch transistor M5–M6 due to the reverse-biased drain-to-body junction.

Transistors M61–M63 are also turned off. Although turned off, a leakage current IL flows out of each transistor M61–M63 due to the reverse-biased drain-to-body junction. As a result, transistors M61–M63 each sink a third compensation current equal to IL, for a total of 3IL. The third compensation currents sunk by transistors M61–M63 sink the leakage current IL output by each first switch transistor M1–M2 connected to the node due to the reverse-biased drain-to-body junction, and by second switch transistor M5 due to the reverse-biased source-to-body junction.

Similarly, transistors M64–M66 are turned off. Although turned off, a leakage current IL flows out of each transistor M64–M66 due to the reverse-biased drain-to-body junction. As a result, transistors M64–M66 each sink a fourth compensation current equal to IL, for a total of 3IL. The fourth compensation currents sunk by transistors M64–M66 sink the leakage current IL output by each first switch transistor M3–M4 connected to the node due to the reverse-biased drain-to-body junction, and by second switch transistor M6 due to the reverse-biased source-to-body junction.

Thus, by using compensation transistors M51–M56 and M61–M66 to sink leakage currents that result from the reverse-biased body junction, the present invention compensates for losses that result from bulk leakage currents.

Figure 8:
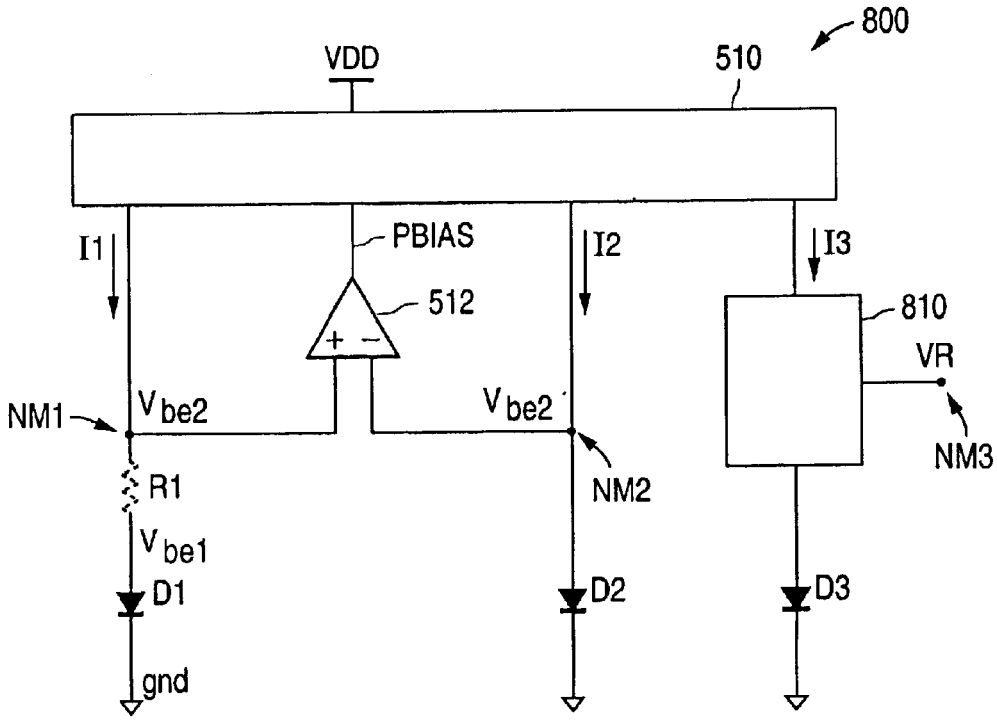
FIG. 8 is a schematic diagram illustrating an example of a bandgap reference circuit 800 in accordance with the present invention.

One application of trim circuit 700 is in a bandgap reference circuit. FIG. 8 shows a schematic diagram that illustrates an example of a bandgap reference circuit 800 in accordance with the present invention. Circuit 800 is similar to circuit 500 and, as a result, utilizes the same reference numerals to designate the structures which are common to both circuits.

As shown in FIG. 8, circuit 800 differs from circuit 500 in that circuit 800 utilizes a trim circuit 810, such as trim circuit 700, in lieu of resistor R2. Circuit 800 operates the same as circuit 500 except that the value of the reference voltage VR can be tuned depending on which first and second switching transistors are turned on and off.

Figure 9:
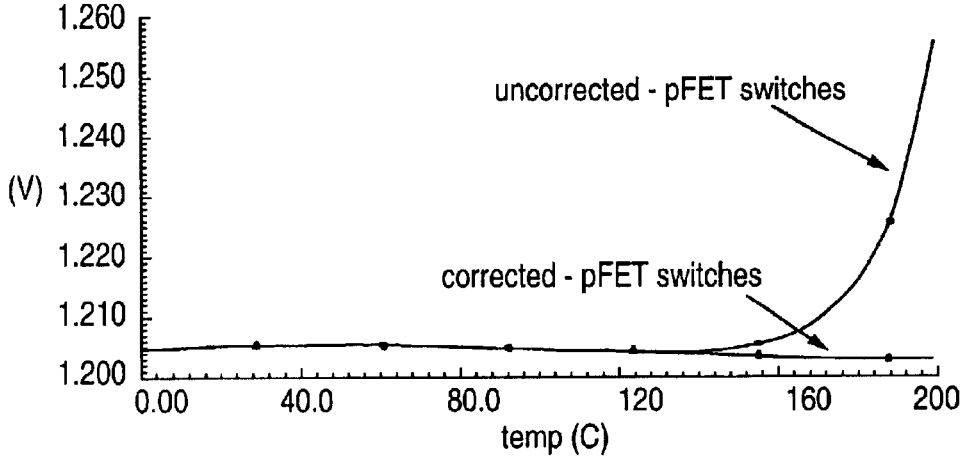
FIG. 9 shows a graph illustrating an example of the reference voltage VR output from bandgap circuit 800 over temperature when trim circuit 700 includes and excludes compensation transistors M51–M56 and M61–M66 in accordance with the present invention.

FIG. 9 shows a graph that illustrates an example of the reference voltage VR output from bandgap circuit 800 over temperature when a four-bit version of trim circuit 700 includes (corrected) and excludes (uncorrected) compensation transistors (transistors M51–M56 and M61–M66 in the two-bit FIG. 7 example) in accordance with the present invention.

As shown in FIG. 9, the effect of the PMOS well leakage can be corrected for almost exactly. In the FIG. 7 example, when compensation transistors M51–M56 and M61–M66 are not utilized, the current through resistor R2*a* and diode D3 is greater than the current input to circuit node NCC due to the addition of 12IL, 2IL from each of the six switches M1–M6. In a system with 30 switches, the additional leakage current totals 30(2IL)=60IL.

At 200° C., the leakage current IL is approximately 18.56 nA, making the total difference in current between circuit node NCC and diode D3 equal to 1.11 uA. As noted above, the effect of the PMOS well leakage can be corrected for almost exactly. Alternately, compensation transistors M51–M56 and M61–M66 can be eliminated if PMOS switch transistors M1–M6 are implemented as NMOS transistors.

Figure 10:
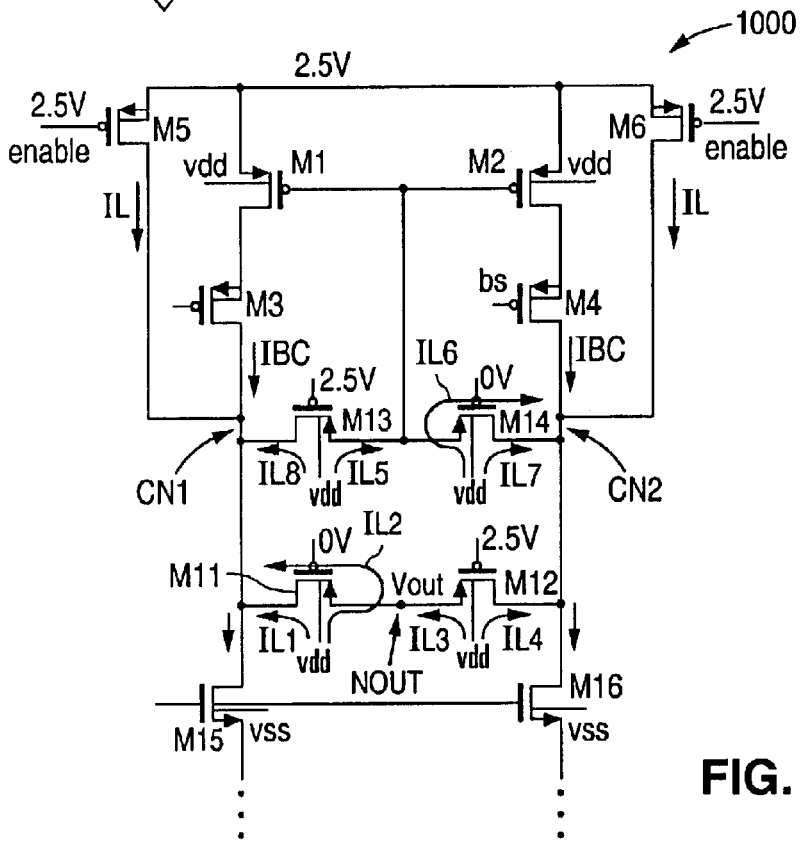
FIG. 10 is a schematic diagram illustrating an example of an amplifier output stage 1000 in accordance with the present invention.

FIG. 10 shows a schematic diagram that illustrates an example of an amplifier output stage 1000 in accordance with the present invention.

As shown in FIG. 10, output stage 1000 includes source transistors M1–M2, bias transistors M3–M4, and enable transistors M5 and M6. Each source transistor M1 and M2 has a drain, a source and body connected to a power supply voltage VDD, and gates connected to each other.

Bias transistor M3 has a drain connected to a circuit node CN1, a source and body connected to the drain of source transistor M1, and a gate, while bias transistor M4 has a drain connected to a circuit node CN2, a source and body connected to the drain of source transistor M2, and a gate.

Enable transistor M5 has a drain connected to circuit node CN1, a source and body connected to the power supply voltage VDD, and a gate. Enable transistor M6 has a drain connected to circuit node CN2, a source and body connected to the power supply voltage VDD, and a gate.

When stage 1000 is enabled, transistors M5 and M6 are turned off. Although turned off, transistors M5 and M6 each source a leakage current IL due to the reverse-biased drain-to-body junction. At the same time, each transistor M3 and M4 outputs a bias current IBC based on the voltages on the gates of transistors M1/M3 and M2/M4, respectively. As a result, the total current received by circuit node CN1 is equal to IBC+IL, while the total current received by circuit node CN2 is equal to IBC+IL.

As further shown in FIG. 10, stage 1000 also includes four switch transistors M11–M14. Transistor M11 has a drain connected to circuit node CN1, a gate, a source connected to an output node NOUT, and a body connected to the power supply VDD. Transistor M12 has a drain connected to circuit node CN2, a gate, a source connected to output node NOUT, and a body connected to the power supply VDD.

Transistor M13 has a drain connected to circuit node CN1, a gate connected to the gate of transistor M12, a source connected to the gates of transistors M1 and M2, and a body connected to the power supply VDD. Transistor M14 has a drain connected to circuit node CN2, a gate connected to the gate of transistor M11, a source connected to the gates of transistors M1 and M2, and a body connected to the power supply VDD.

As additionally shown in FIG. 10, stage 1000 includes two bias transistors M15–M16. Transistor M15 has a drain connected to circuit node CN1, a gate connected to receive a bias voltage, a source, and a body. Transistor M16 has a drain connected to circuit node CN2, a gate connected to receive the bias voltage, a source, and a body.

In operation, gate signals 180° out-of-phase are used to turn transistors M11/M14 and M12/M13 on and off such that transistors M11 and M14 are turned on and transistors M12 and M13 are turned off for half a period, and transistors M11 and M14 are turned off and transistors M12 and M13 are turned on for half a period. FIG. 10 illustrates the case where transistors M11 and M14 are turned on and transistors M12 and M13 are turned off.

As shown in FIG. 10, when transistor M11 is turned on and transistor M12 is turned off, three bulk leakage currents IL1–IL3 flow to circuit node CN1, and one bulk leakage current IL4 flows to circuit node CN2. The first leakage current IL1 results from the reverse-biased drain-to-body junction of transistor M11, and the second leakage current IL2 results from the reverse-biased source-to-body junction of transistor M11. The third leakage current IL3 results from the reverse-biased source-to-body junction of transistor M12, and the fourth leakage current IL4 results from the reverse-biased drain-to-body junction of transistor M12.

In addition, when transistor M14 is turned on and transistor M13 is turned off, three bulk leakage currents IL5–IL7 flow to circuit node CN2, and one bulk leakage current IL8 flows to circuit node CN1. The fifth leakage current IL5 results from the reverse-biased source-to-body junction of transistor M13, while the sixth and seventh leakage currents IL6 and IL7 results from the reverse-biased source-to-body and drain-to-body junctions of transistor M14. The eighth leakage current IL8 results from the reverse-biased drain-to-body junction of transistor M13.

As a result, the total current flowing into the drains of transistors M15 and M16 is equal to IBC+5IL (IBC+IL+IL1+IL2+IL3+IL8 and IBC+IL+IL4+IL5+IL6+IL7). Thus, in accordance with the present invention, op amp stage 1000 has balanced current flowing in both legs of the amplifier.

If the currents in the output legs of the amplifier become unbalanced, then the input to the amplifier will not be equal. Any mismatch between the inputs gets gained through the system and appears directly as a DC shift in the reference voltage VR.

Figure 11:
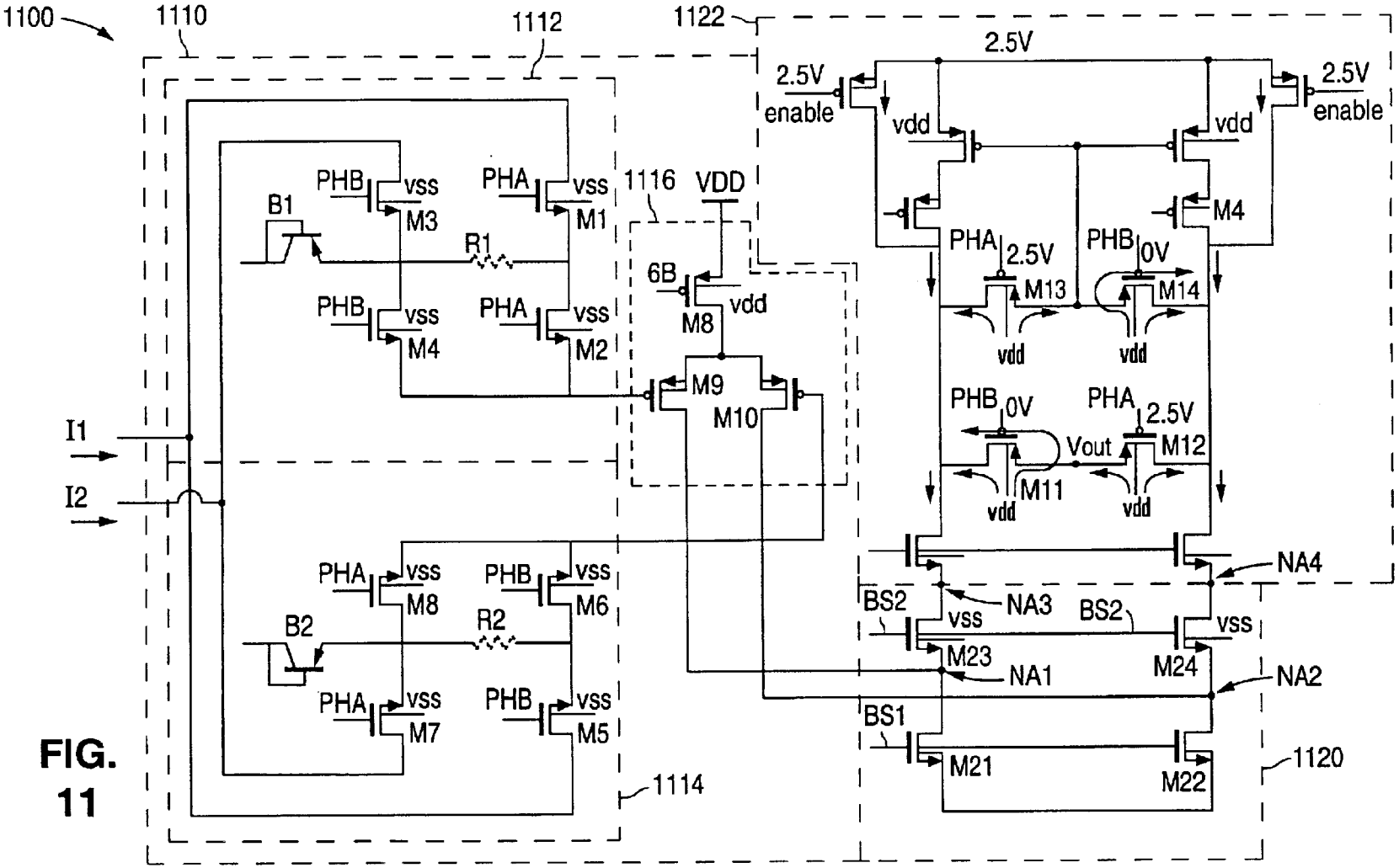
FIG. 11 is a schematic diagram illustrating an example of a folded cascade operational amplifier (op amp) 1100 in accordance with the present invention.

One application of amplifier output stage 1000 is in an operational amplifier. FIG. 11 shows a schematic diagram that illustrates an example of a folded cascade operational amplifier (op amp) 1100 in accordance with the present invention. As shown in FIG. 11, op amp 1100 includes an input stage 1110 that varies the voltage on a first amp node NA1 and a second amp node NA2 in response to a first output current I1 and a second output current I2. Continuing with the example of FIG. 1, second output current I2 is 10× larger than first output current I1.

Input stage 1110, in turn, includes a first switching circuit 1112 and a second switching circuit 1114. First switching circuit 1112 includes first, second, third, and fourth NMOS transistors M1, M2, M3, and M4, respectively. First NMOS transistor M1 has a gate connected to receive a first phase signal PHA, a drain connected to receive the first output current I1, a source, and a body connected to ground.

Second NMOS transistor M2 has a gate connected to receive the first phase signal PHA, a drain connected to the source of transistor M1, a source, and a body connected to ground. Third NMOS transistor M3 has a gate connected to receive a second phase signal PHB, a drain connected to receive the second output current I2, a source, and a body connected to ground. Fourth NMOS transistor M4 has a gate connected to receive the second phase signal PHB, a drain connected to the source of transistor M3, a source connected to the source of transistor M2.

In addition, a first resistor R1 that is connected between the sources of transistors M1 and M3, and a diode-connected bipolar transistor B1 are shown. Transistor B1 has an emitter connected between the source of transistor M3 and ground, and a base and collector that are connected to ground.

Second switching circuit 1114 includes fifth, sixth, seventh, and eighth NMOS transistors M5, M6, M7, and M8, respectively. Fifth NMOS transistor M5 has a gate connected to receive the second phase signal PHB, a drain connected to receive the first current I1, a source, and a body connected to ground.

Sixth NMOS transistor M5 has a gate connected to receive the second phase signal PHB, a drain connected to the source of transistor M5, a source, and a body connected to ground. Seventh NMOS transistor M7 has a gate connected to receive the first phase signal PHA, a drain connected to receive the second output current I2, a source, and a body connected to ground. Eighth NMOS transistor M8 has a gate connected to receive the first phase signal PHA, a drain connected to the source of transistor M7, a source connected to the source of transistor M6, and a body connected to ground.

In addition, a second resistor R2 that is connected between the sources of transistors M5 and M8, and a diode-connected bipolar transistor B2 are shown. Transistor B2 has an emitter connected between the source of transistor M7 and ground, and a base and collector that are connected to ground. (Resistor R2 and transistor B2 function as resistor R2 and diode D3 in FIG. 5.)

In addition to first and second switching circuits 1112 and 1114, input stage 1110 includes a differential stage 1116 that varies the magnitudes of the currents that flow into the first and second amp nodes NA1 and NA2 in response to the first and second switching circuits 1112 and 1114.

Differential stage 1116 includes first, second, and third PMOS transistors M8, M9, and M10. PMOS transistor M8 has a gate connected to a gate bias signal GB, a drain, a source connected to a power supply VDD, and a body connected to the power supply VDD. PMOS transistor M9 has a gate connected to the sources of transistors M2 and M4, a drain connected to first amp node NA1, and a source and body connected to the drain of transistor M8. PMOS transistor M10 has a gate connected to the sources of transistors M6 and M8, a drain connected to second amp node NA2, and a source and body connected to the drain of transistor M8.

As shown in FIG. 11, in addition to input stage 1110, op amp 1100 also includes a bias stage 1120 that includes NMOS transistors M21–M24. NMOS transistor M21 has a gate connected to receive a first bias signal BS1, a drain connected to the first amp node NA1, a source connected to ground, and a body connected to ground. NMOS transistor M22 has a gate connected to receive the first bias signal BS1, a drain connected to the second amp node NA2, a source connected to ground, and a body connected to ground.

NMOS transistor M23 has a gate connected to receive a second bias signal BS2, a drain connected to a third amp node NA3, a source connected to the first amp node NA1, and a body connected to ground. NMOS transistor M24 has a gate connected to receive the second bias signal BS2, a drain connected to a fourth amp node NA4, a source connected to the second amp node NA2, and a body connected to ground.

As further shown in FIG. 11, op amp 1100 additionally includes an amplifier output stage 1122, such as amplifier output stage 1000, that is connected to amp nodes NA3 and NA4. As shown, the gates of transistors M12 and M13 are connected to phase signal PHA, while the gates of transistors M1 and M14 are connected to phase signal PHB.

In operation, the phase signals PHA and PHB, which are 180° out-of-phase, switch the inputs to transistors M9 and M10, thereby substantially reducing an offset voltage that can result from random variation in the threshold voltages of transistors M9 and M10. (Random variation in the threshold voltage of a transistor can be modeled as a DC voltage in series with the gate.) The reduction in the offset voltage is further described in U.S. Pat. No. 6,535,054 to Ceekala et al. issued on Mar. 18, 2003 which is hereby incorporated by reference.

Figure 12A:
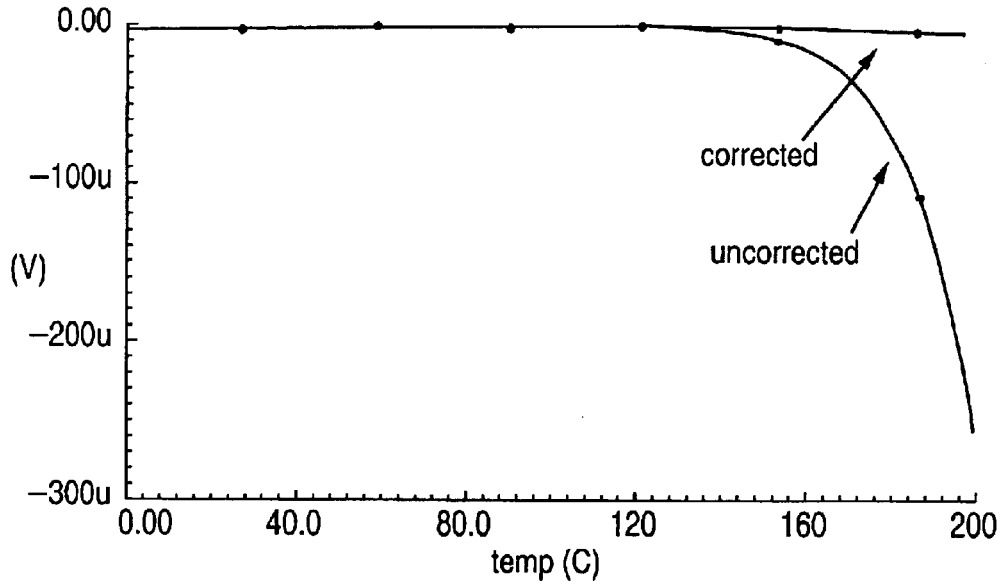
FIGS. 12A–12B are graphs illustrating an example of the operation of op amp 1100 in accordance with the present invention.
Figure 12B:
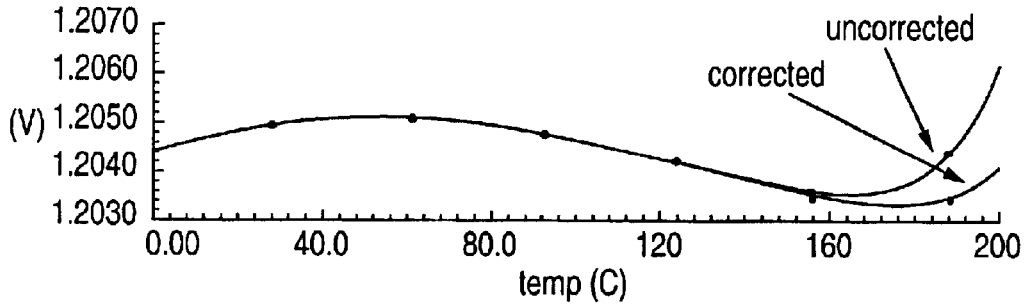

FIGS. 12A–12B show graphs that illustrate an example of the operation of op amp 1100 in accordance with the present invention. FIG. 12A shows an input offset voltage v. temperature with transistors M5 and M6 (corrected) and without transistors M5 and M5 (uncorrected).

FIG. 12B shows the operation of a bandgap circuit, such as circuit 500, where op amp 512 is implemented with op amp 1100 with transistors M5 and M6 (of FIG. 10) (corrected) and without transistors M5 and M6 (of FIG. 10) (uncorrected). When uncorrected, only a single enable transistor is connected between the gates of transistors M1 and M2 of FIG. 10 and a power supply VDD which, in turn, causes a mismatch in the currents in the two legs. This mismatch appears as a mismatch at the input of an amplifier.

FIG. 12A shows the difference between the amplifier inputs as a function of temperature for the corrected and uncorrected op amp. This difference becomes a difference in the reference voltage VR as shown in FIG. 12B. While the difference in input voltage is small (less than 300 uV), this difference gets gained through the system to create an error of several millivolts at the reference voltage VR.

It should be understood that the above descriptions are examples of the present invention, and that various alternatives of the invention described herein may be employed in practicing the invention. Thus, it is intended that the following claims define the scope of the invention and that structures and methods within the scope of these claims and their equivalents be covered thereby.

What is claimed is:

1. A leakage compensation circuit comprising:

a circuit node;

a first PMOS transistor having a source connected to the circuit node, a drain, a gate, and a body, a first leakage current flowing out of the first PMOS transistor; and a second PMOS transistor connected to the first PMOS transistor, the second PMOS transistor having a source, a drain, a gate connected to receive a positive turn off voltage, and a body, the second PMOS transistor sinking a current substantially equal to the first leakage current.

2. The leakage compensation circuit of claim 1 wherein the drain of the first PMOS transistor is connected to the source of the second PMOS transistor.

3. The leakage compensation circuit of claim 2 and further comprising:

a third PMOS transistor having a source, a drain connected to the source of the second PMOS transistor, a gate, and a body, a second leakage current flowing out of the drain of the third PMOS transistor; and a fourth PMOS transistor having a source connected to the drain of the third transistor, a drain, and a gate connected to receive the positive turn off voltage, the fourth PMOS transistor sinking a current substantially equal to the second leakage current.

4. The leakage compensation circuit of claim 1 wherein:

the body of the first PMOS transistor is connected to a positive voltage; and the source and the body of the second PMOS transistor are connected to the circuit node.

5. The leakage compensation circuit of claim 4 wherein the circuit node receives an input current, and substantially none of the input current flows into the first PMOS transistor.

6. The leakage compensation circuit of claim 5 and further comprising:

a resistive node;

a resistive element connected to the circuit node and the resistive node;

a third PMOS transistor having a source connected to the resistive node, a drain, a gate, and a body, a second leakage current flowing out of the third PMOS transistor, substantially none of the input current flowing into the third PMOS transistor; and a fourth PMOS transistor having a source and a body connected to the resistive node, a drain, and a gate connected to receive the positive turn off voltage, the fourth PMOS transistor sinking a current substantially equal to the second leakage current.

7. The leakage compensation circuit of claim 1 and further comprising a plurality of individual PMOS transistors connected to an internal node, the first PMOS transistor being one of the one or more individual PMOS transistors, one or more individual PMOS transistors outputting one or more source currents to the internal node, one or more individual PMOS transistors outputting one or more leakage currents to the internal node, the first leakage current being one of the one or more leakage currents.

8. The leakage compensation circuit of claim 7 and further comprising a plurality of compensation PMOS transistors connected to the Internal node, the second PMOS transistor being one of the one or more compensation PMOS transistors.

9. The leakage compensation circuit of claim 8 wherein the source and body of the compensation PMOS transistors are connected to the internal node to sink current from the internal node.

10. The leakage compensation circuit of claim 8 wherein the source and drain of the compensation PMOS transistors are connected to the internal node, the compensation current sunk by the second transistor being output to the internal node.

11. The leakage compensation circuit of claim 8 wherein the source and drain of the second PMOS transistor is connected to the internal node.

12. The leakage compensation circuit of claim 8 and further comprising a third PMOS transistor having a source connected to the circuit node, a drain, a gate, and a body.

13. The leakage compensation circuit of claim 12 and further comprising a fourth PMOS transistor having a source connected to the circuit node, a drain, a gate, and a body.

14. The leakage compensation circuit of claim 13 wherein the gate of the first PMOS transistor receives a first voltage, the gate of the third PMOS transistor receives a second voltage, and the gate of the fourth PMOS transistor receives a third voltage, the first and second voltages having equivalent periods, the first voltage having a shorter duty cycle than the second voltage.

15. The leakage compensation circuit of claim 1 wherein the drains of the first and second PMOS transistors are connected to a drain node.

16. The leakage compensation circuit of claim 15, wherein the current sunk by the second transistor is output to the drain node.

17. The leakage compensation circuit of claim 15 and further comprising:

a third PMOS transistor having a source connected to the circuit node, a drain, a gate, and a body, a second leakage current flowing out of the third PMOS transistor; and a fourth PMOS transistor connected to the third PMOS transistor, the fourth PMOS transistor having a source, a drain connected to the drain of the third transistor, a gate, and a body.

18. The leakage compensation circuit of claim 3 and further comprising:

an operational amplifier having a positive input connected to the drain of the first transistor and a negative input;

a resistor connected to the positive input of the operational amplifier; and a diode connected between the resistor and ground.

19. A method of compensating for leakage currents in a switched current source that includes a plurality of transistors connected to a common node, the method comprising the steps of:

determining a number of turned on transistors of the plurality of transistors that each source a first current into the common node at a same time;

determining a number of turned off transistors of the plurality of transistors that each source a leakage current into the common node at the same time; and determining a number of compensation transistors to connect to the common node to provide a compensation current, the compensation current having a value that eliminates an effect of the leakage current from the turned off transistors.

20. A method of forming a leakage compensated circuit, the leakage compensated circuit having a common node, a plurality of circuit nodes, a plurality of input currents flowing into the plurality of circuit nodes, and a plurality of individual PMOS transistors connected to the common node and the circuit nodes so that each individual PMOS transistor is connected to the common node and a circuit node, each of one or more individual PMOS transistors outputting a source current to the common node, the source current being less than the input current flowing into a circuit node, each of one or more individual PMOS transistors outputting a leakage current to the common node, the method comprising the steps of:

determining a number of individual PMOS transistors that output the source current at a same time;

determining a difference between the magnitude of the source current and the magnitude of the input current;

multiplying the difference times the number of individual PMOS transistors that output the source current at the same time to obtain a total current loss;

determining a number of individual PMOS transistors that output a leakage current at a same time;

multiplying the number of individual PMOS transistors that output the leakage current at one time times the leakage current to obtain a total added leakage current that is input to the common node;

combining the total current loss and the total added leakage current to determine a combined result;

determining a compensation leakage current provided by a compensation PMOS transistor; and connecting a number of compensation PMOS transistors to the common node so that the total compensation leakage current is equal with an opposite magnitude of the combined result.

* * * * *

UNITED STATES PATENT AND TRADEMARK OFFICE

CERTIFICATE OF CORRECTION

PATENT NO. : 6,833,751 B1
DATED : December 21, 2004
INVENTOR(S) : Atrash

It is certified that error appears in the above-identified patent and that said Letters Patent is hereby corrected as shown below:

Column 1,
Line 6, delete “witched” and replace with -- switched --.

Column 2,
Line 15, delete “C13” and replace with -- C1-C3 --.

Column 3,
Line 1, delete “52” and replace with -- S2 --.
Lines 2 and 3, delete “53” and replace with -- S3 --.
Line 27, delete “CS1-S16” and replace with -- CS1-CS16 --.
Line 59, delete “Internal” and replace with -- internal --.

Column 4,
Line 49, delete “M11-M13” and replace with -- M1-M13 --.
Line 55, delete “Internal” and replace with -- internal --.

Column 5,
Line 19, delete “inks” and replace with -- sinks --.

Column 6,
Line 16, delete “Cs1I” and replace with -- CS11 --.

Column 9,
Line 58, delete “Is”and replace with -- is --.

Column 14,
Line 34, delete “M1” and replace with -- M11 --.

UNITED STATES PATENT AND TRADEMARK OFFICE

CERTIFICATE OF CORRECTION

PATENT NO. : 6,833,751 B1
DATED : December 21, 2004
INVENTOR(S) : Atrash

It is certified that error appears in the above-identified patent and that said Letters Patent is hereby corrected as shown below:

Column 16,
Line 1, delete "Internal" and replace with -- internal --.

Signed and Sealed this

Twenty-ninth Day of March, 2005

JON W. DUDAS
*Director of the United States Patent and Trademark Office*